US005388345A

United States Patent [19]

Brundage et al.

[11] Patent Number: 5,388,345

[45] Date of Patent: Feb. 14, 1995

[54] DIELECTRIC DRYING OF METAL STRUCTURES

[75] Inventors: Kevin R. Brundage, Corning; Tudor C. Gheorghiu, Painted Post, both of N.Y.; Victor F. Janas, Robbinsville, N.J.; Vincent Kwapong, Corning; Christopher J. Malarkey, Painted Post, both of N.Y.

[73] Assignee: Corning Incorporated, Corning, N.Y.

[21] Appl. No.: 147,755

[22] Filed: Nov. 4, 1993

[51] Int. Cl.[6] ..... F26B 3/34

[52] U.S. Cl. ..... 34/256; 34/68; 34/255; 34/441; 264/25

[58] Field of Search ..... 34/104, 105, 21, 1 E, 34/1 K, 1 L, 17, 68, 437, 441, 250, 255, 256; 219/764, 780, 78.11; 264/25, 26, 56, 57

[56] References Cited

U.S. PATENT DOCUMENTS

| | | | |
|---|---|---|---|
| 1,893,314 | 1/1933 | Willetts | 264/57 |
| 3,352,951 | 11/1967 | Sara | 264/56 |
| 3,790,654 | 2/1974 | Bagley | 264/177 |
| 3,904,352 | 9/1975 | Thurnauer et al. | 432/5 |
| 4,259,061 | 3/1981 | Dubetsky | 432/13 |
| 4,330,270 | 5/1982 | Herrold | 432/259 |
| 4,439,929 | 4/1984 | Kitagawa et al. | 34/1 |
| 4,758,272 | 7/1988 | Pierotti et al. | 75/246 |
| 4,786,542 | 11/1988 | Yasuda et al. | 264/57 |
| 4,837,943 | 6/1989 | Mitzutani | 34/1 E |
| 4,857,245 | 8/1989 | Oshima et al. | 264/25 |
| 4,866,857 | 9/1989 | Clasen | 34/10 |
| 5,149,264 | 9/1992 | Horikawa et al. | 432/2 |
| 5,263,263 | 11/1993 | Gheorghiu et al. | 34/1 K |

*Primary Examiner*—Denise L. Gromada
*Attorney, Agent, or Firm*—Angela N. Nwaneri

[57] ABSTRACT

A method of drying plastically deformable metal structures using high frequency energy in a frequency range greater than 10 MHz. The highly efficient drying of the invention is accomplished by shielding the structure from the electrodes using a material whose dielectric constant is greater than that of air.

29 Claims, 3 Drawing Sheets

DIELECTRIC DRYING OF METAL STRUCTURES

BACKGROUND OF THE INVENTION

This invention relates to a method of drying metal structures by applying high frequency energy such as dielectric energy and microwave radiation.

A long-standing problem with forming of plastically deformable materials which use liquids as part of the plasticizing system has been the delicate balance required to obtain material which is plastic enough to form with relative ease, and which is at the same time self-supporting and easy to handled in the wet or green state. In general, self-supporting pieces are obtained by drying. As liquid is removed, the strength of the formed body tends to increase and the body becomes more self-supporting and easier to handle. The most common method for removing liquid from formed bodies is the application of heat. A particular problem with the application of heat to such formed pieces is that surface defects, such as cracks, checks and fissures, tend to develop when heat is applied. This is because heat tends to dry the immediate surface nearest the heat source causing the formation of a skin which in turn tends to retard further evaporative drying of the body. Thus, as more heat is applied, the skin becomes thicker, trapping liquid inside the body. As the temperature increases, the trapped liquid approaches its boiling temperature, and formed vapors escape forming fissures, cracks, and other surface defects.

Certain honeycomb structures are produced from very fine metal, ceramic, glass and carbon powders and a high level of binders and water. Typically, due to the large surface area of the fine powders, the mixture requires the addition of a large amount of water sometimes more than 150 weight % based on the weight of powders in the matrix. As a result of the high water content of the matrix, structures formed from the matrix require very long drying times tend to develop cracks and fissures during the drying operation due to differential shrinkage. Consequently, the dimensional stability of such structures has remained largely unacceptable, resulting in a large number of such structures being rejected in the drying operation. This problem is particularly severe when forming complex structures such as thin-walled, honeycomb structures formed by extrusion.

Several methods have been suggested for improving the dimensional stability of formed structures. For example, it has been suggested to use high intensity energy or electromagnetic radiation, such as microwave, dielectric etc., as well as conventional drier to partially dry formed carbon articles. After forming, the wet formed carbon structure is contacted with microwave radiation to quickly remove a portion of the water in the matrix. However, after a certain critical amount of the water in the matrix has been lost, arcing occurs and if the radiation is not discontinued, the structure is eventually destroyed. After contacting the body with microwave radiation to remove a certain amount of the water, it is placed in a conventional oven at 60°–150° C., to substantially complete the drying. The critical level of water loss at which arcing will occur will depend on several factors including the initial amount of water in the matrix as well as the size and composition of the formed article.

One recognized method of drying ceramic bodies is by the application of dielectric or high frequency energy. For example, U.S. Pat. No. 4,439,929 discloses an apparatus for drying ceramic green honeycomb bodies using two facing electrodes having a space between them through which the green ceramic bodies may be passed while a dielectric heating energy source is connected to the electrodes and activated. An electric field, which encompasses the green ceramic honeycomb body is created within the space between the electrodes. The electric field then causes the creation of heat energy within the green ceramic body by excitation of the polar water molecules included within the body. The heat energy generated within the body raises the temperature of the body to the evaporation point of the liquids, thereby causing drying of the body.

U.S. Pat. No. 3,953,703 (Hurwitt) discloses a method for drying ceramic tape using high frequency energy, preferably in the microwave range, to uniformly raise the temperature of the ceramic slip which has been cast on a belt to evaporate volatile solvents from the interior of the tape without forming a barrier skin on the surface of the thin layer of slip.

U.S. Pat. No. 3,372,445 (Maurer et al.) describes a press for drying ceramic and other materials in the plastic state which involves predrying the extruded ceramic material prior to its separation from the press. Maurer's press includes a minimum of three axially elongated electrodes connected to a source of polyphase electric current and arranged such that extruded material, particularly ceramic material in the plastic state, is passed through the space in the center of said electrodes for the purpose of predrying the material prior to its separation from the press. Maurer et al. teach that extruded ceramic material, which passes through the space surrounded by the mentioned electrodes connected to a polyphase current source, is heated and dried by the electric field created by the electrodes. While the use of high frequency energy has proved useful for the drying of ceramic bodies, high frequency energy is not a practical method for drying electrically conductive structures particularly metals.

It is well known that metals are not compatible with high frequency energy such as dielectric and microwave energy. Recently, a method has been disclosed for uniformly heating plastically deformable material containing electrically conductive particulate matter, by induction heating. Induction heating is accomplished by placing the plastically deformable material in proximity with an induction device through which an electric current of appropriate frequency is passed, thus causing induction of an electric current or hysteresis loss within the material. Induction causes hysteresis loss within the electrically conducting particulate matter and generates heat which then uniformly heats the plastically deformable material causing it to stiffen or rigidify.

U.S. Pat. No. 3,352,951 (Sara) discloses a method of forming high density refractory carbide article by encapsulating the article within electrically conductive material having a higher melting point than the article. The encapsulated article is then sintered at a temperature just below the melting point of the article. The sintering occurs under an inert atmosphere and is accomplished by inductive heating of the electrically conductive capsule which surrounds the formed carbide article. However, induction heating is not an efficient method of drying because of the relatively low frequency range (100–3000 Hz). Further, application of inductive heat to an article formed of plastically deformable material may be disadvantageous since it is difficult to distribute the heat quickly and evenly throughout the body. Slow heating leaves the forming process with the same problem of sagging, collapsing articles. Differential heating, across the body, may lead to problems such as differential shrinkage, skin formation in the immediate vicinity of the applied heat which in turn leads to various surface defects such as cracks, fissures, or checks. Differential heating may also cause deformation of the formed body by developing opposing compression and tension forces, the tension forces being developed by faster shrinkage of the outside of a formed body.

Other methods for stiffening plastically deformable material have been suggested involving application of radio frequency energy to a formed article. However, application of radio frequency energy in many cases, causes severe problems when applied to bodies comprising electrically conductive materials, particularly metals because even moderate exposure to such radio frequency is likely to cause arcing and destroy the body. It is well known that metals are not compatible with high frequency energy. Metallic articles or articles formed from particulate metal-containing material, and which are subjected to radio frequency energy tend to be pyrophoric, particularly when very small particles of metal are used in the material since the small particles are more prone to rapid oxidation. Exposure to radio frequency energy, for more than a few seconds, leads to preferential edge heating of the formed body which is then followed by rapid oxidation and likely ignition of the material. Thus, exposure of metal particle containing formed bodies to RF energy is likely to cause severe burning unless the time of exposure is limited by a time consuming and impractical process of sequential on-off operation of the RF device.

To the best of our knowledge, to date, there have been no teachings or suggestions to dry metal articles using high frequency energy such as dielectric and microwave energy. Accordingly, it is the object of the present invention to provide an apparatus and method of drying metal ware using high frequency energy while avoiding the above recited problems.

SUMMARY OF THE INVENTION

The present invention provides a method of drying plastically deformable metallic material using high frequency energy. Briefly, the invention provides a method of drying an electrically conductive structure by placing a wet or green electrically conductive structure in a shield having dielectric constant higher than the dielectric constant of air, and surrounding the shield and structure with an electromagnetic energy field in the frequency range of between about 10 MHz and 3.0 GHz to dry the structure.

Additionally, this method may be used to accomplish curing of the plastically deformable material, burnout of volatile components, or sintering of the material. In particular, the invention provides an apparatus and method for uniformly heating plastically deformable electrically conductive materials (e.g., metallic material), using high frequency electromagnetic radiation. By high frequency, we mean frequency greater than 10 MegaHertz, preferably greater than 12 MHz, more preferably in the range of 12 MHz to 3.0 GHz.

A key aspect of the invention is the apparatus and method of shielding a metal structure from direct exposure to the electrodes used in a dielectric drying medium. The shielding material possesses a high dielectric constant. As a result of the high dielectric constant, the field strength inside the structure is reduced preventing dielectric breakdown and arcing from the structure to the electrodes.

There are several advantages to this method. For example, it provides a faster, more uniform, and more efficient drying process than traditional drying methods such as conventional and inductive drying. As a result of the faster drying achieved by this process, the metal particles from which the metal structures are formed are less likely to rust during processing.

DETAILED DESCRIPTION OF THE INVENTION

Figure 1A:
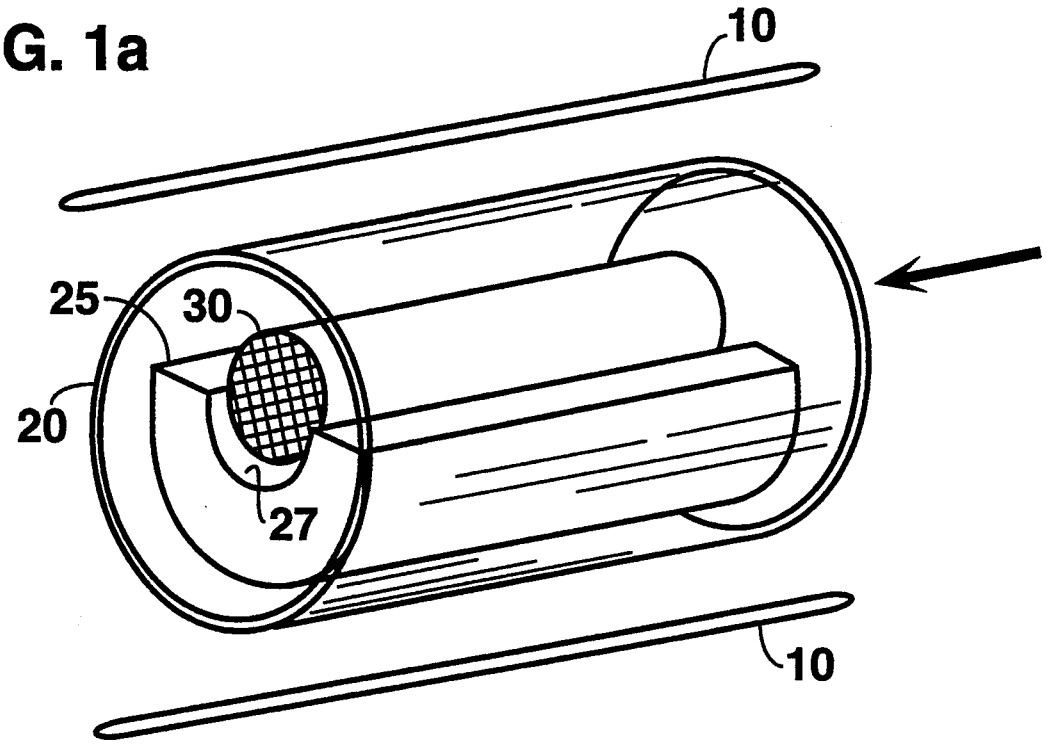
FIG. 1*a* is a schematic diagram showing the relative placement of the shielding material, cradle, metal structure and the electrodes in a horizontal dryer using a quartz tube as a shield.

The method of the invention is useful for drying any electrically conductive material. However, for ease of discussion the following description of the method refers to metal structures by way of illustration of electrically conductive material only, and is not intended as a limitation.

The metal structures of the invention can be used in various applications, particularly those in which the structures are exposed to high temperatures, such as for example, in catalytic supports for exhaust gas purification devices, heaters such as catalyzed heaters and electrically heated catalysts (EHCs), catalytic converters, and many other applications.

The metal structures can be of any desired configurations. Typically, they are formed from plastically deformable metallic mixtures using various forming devices such as for example, ram and twin-screw extruders. The metal and/or metal alloy composition is typically combined with a binder, preferably an organic binder such as methyl cellulose, polyvinyl alcohol, etc., a vehicle, and optionally other aids such as aids to prevent oxidation (e.g., oleic acid), or aids to form a homogeneous wet mixture. The mixture can contains up to about 150% water based on the amount of solids. For example, for certain highly porous particulates such as activated carbon compositions, super additions of water (up to about 150%) is required to form such mixtures. For metal catalysts such as electrically heated catalysts, the mixtures may contain from 50 to 65% water based on the amount of metal particles.

For certain preferred applications such as for electrically heated catalysts (EHCs), the structures are of the honeycomb configuration, and more preferably, such honeycomb structures are formed by extrusion. Honeycomb structures are characterized by numerous passageways or cells all defined by a matrix of cell walls. The cells can have any cross-sectional shape such as for example, circular, or polygonal. The size and dimensions of the structures are only limited by the desired application. Thus, the diameter, length, number of cells, or cell wall thickness can be any value depending on the limitations of the particular application. As stated earlier, for our preferred applications, extruded honeycomb structures have been found to be particularly useful.

The metal structure can be processed using any appropriate method. Such methods are well known in the art, for example, by extrusion. Particularly useful compositions for electrically heated catalyst (EHCs), which can be processed by the drying methods of the invention consists essentially of, in percent by weight, about 5 to 40 chromium, about 2 to about 30 aluminum, 0 to about 5 of special metal described below, 0 to about 4 of rare earth oxide additive, and the balance being iron group metal and unavoidable impurities, wherein the composition includes at least one component selected from (a) the special metal, and (b) an effective amount of the rare earth oxide additive, to enhance the life of the body. The special metal includes metals that impart or enhance desired properties in the structure such as, for example, oxidation resistance and/or metals that are used as densification aids in the sintering operation. The special metals are selected from Y, lanthanides, Zr, Hf, Ti, Si, B, alkaline earth metal, Cu, and Sn.

One composition which has been found to be particularly useful for catalytic converter applications includes, but is limited to such applications, is, in weight percent: (1) about 5 to about 40 chromium, (2) about 2 to about 30 aluminum, (3) at least one component selected from about 0.01 to about 5 of at least one element selected from the following group A elements: Y, lanthanides, Zr, Hf, Ti, Si, and alkaline earth metal, and/or the following group B elements: B, Si, La, Ce, Cu, and Sn; (4) up to about 4 of rare earth oxide additive, and the remainder being iron group metal and unavoidable impurities.

Other useful compositions for forming metal honeycomb structures are given in Tables 1 and 2 below.

TABLE 1

| Material | Supplier | Weight |
|---|---|---|
| Sponge Iron MH300 (−270 mesh) | Hoeganaes Archer | 27 lbs (12.27 kg) |
| Iron Aluminum Fe/Al 50 | Shieldalloy | 23 lbs (10.45 kg) |
| Zinc (lot 880435) | Fisher Scientific | 0.25 lbs (114 g) |
| Oleic acid (reagent grade) | Mallinckrodt | 0.5 lbs (228 g) |
| Zinc stearate | Witco | 0.5 lbs (228 g) |
| Methyl cellulose | Dow Chemical | 4 lbs (1.82 kg) |
| Cold Deionized Water | — | 7.25 lbs (3.3 kg) |

TABLE 2

| Material | Supplier | Weight |
|---|---|---|
| Fe/50 Al powder (screened −400 mesh) | Shieldalloy | 23 lbs. (10.45 kg) |
| Oleic Acid (reagent grade) | Mallinckrodt | 0.5 lbs. (.23 kg) |
| Methyl Cellulose | Dow Chemical | 3 lbs. (1.36 kg) |
| Iron Powder (carbonyl OM) | BASF | 27 lbs. (12.27 kg) |

The above compositions can be mixed to form plastically deformable material using various known methods. For the experiments discussed in the Examples, the above mixtures were mixed for five minutes under an argon blanket in a Littleford mixer. After mixing, each batch was wrapped in plastic and chilled overnight in a refrigerator. A quantity of deionized water was also chilled over night in a separate container. Using a medium-sized, chilled Simpson mixmuller, 7.1 lbs. (3.23 kg) of the chilled deionized water was added over a two minute mulling period to the chilled batch and mixed for an additional two minutes. After final mixing, the batch was fed into a spaghetti-type extruder where a vacuum was established after which the ram was slowly advanced to force the mixture through the die orifice to form densely packed were "spaghetti." The spaghetti-like extruded material was then extruded in a ram extruder, using a honeycomb die to form the various cellular structures used in the following experiments. All extrusions were conducted vertically.

While the above compositions use methyl cellulose, other binders such as polyvinyl alcohol, can also be used depending on the forming method used. Certain cellulose ether type binders and/or their derivatives, preferably, methylcellulose and/or its derivatives such as hydroxybutylmethylcellulose, hydroxypropylmethylcellulose, hydroxyethylmethylcellulose, sodium carboxymethylcellulose, and mixtures thereof are preferred particularly for forming thin-walled honeycomb structures. Preferred sources of cellulose ether-type binders are the Methocel® A-type binders available from Dow Chemical Company. The most preferred Methocel® A-type binder being Methocel® A4M, a methyl cellulose binder having a gel temperature of 50°-55° C., and a gel strength of 5000 g/cm$^2$ (based on a 2% solution at 65° C.). Because of its high gel strength, a Methocel® A4M-containing article or preform is relatively stiff as it is extruded, however, at room temperature, cracks and fissures may form because the binder does not develop sufficient gel strength at room temperature. Therefore, it is desirable to quickly develop a large gel strength as the article is formed or soon thereafter, so as to resist subsequent cracking due to drying shrinkage.

To aid the gelling of the Methocel® A4M and quickly develop sufficient gel strength, the article or preform is placed in a the dielectric drier using a shield which is characterized by having higher dielectric constant than air, and preferably having higher breakdown voltage than air. For faster drying, air or an inert gas such as nitrogen may be blown on the preform as it is being dried. For example, while the preform is being contacted with electromagnetic energy, air having a temperature higher than the gelling temperature of the binder can be blown on the preform. Since the Methocel® A4M-containing article can be made to develop a large strength quickly to resist cracking, it can be dried at a fast rate (i.e., using a very short drying schedule) without formation of cracks. For binders which are not thermally gellable, lower air temperatures can be used, preferably, air temperatures at or below the gelling temperature of the binder.

Plastically deformable mixtures tend to shrink during the initial drying period. Left uncontrolled, differential shrinkage will occur leading to both surface and structural defects such as fissures and cracks respectively. One method which is currently being used to avoid the occurrence of such defects, is to dry the formed bodies in two stages. In the first stage, air drying, conventional or induction heating, or a combination of these may be used to remove water until shrinkage is complete. In the second stage, the remaining water is removed by drying the article in a conventional oven.

According to the present invention, the rate of drying in the first stage can be significantly increased by using high frequency energy and by shielding the structure from the electrodes using the apparatus of the invention. To dry the wet formed structure, the article is placed or enveloped in a shield and the shield and article are then surrounded with a high frequency energy field to dry the article. After the first stage drying, the structure may then be placed in a conventional oven at a temperature of 60° to 150° C. to complete the drying. Alternatively, the drying may be completed using ambient temperatures. If the second stage involves conventional or other non-uniform drying methods, then drying in the high frequency energy field should be continued until at least 2% preferably up to 50% of the water has been removed (i.e., until less than 98%, preferably 50% or less of the original water content remains). If the article is dried sufficiently in the first stage, then differential shrinkage in the second stage can be minimized. The effects of differential shrinkage in the second stage can be best controlled if about 5% of the water is removed in the first stage using the high frequency energy field.

As contemplated by the present invention, the drying can be completed in one stage using a high frequency energy source such as dielectric or microwave energy. In this embodiment, the structure is surrounded by high frequency energy until substantially all of the water content is lost (i.e., to reduce the water content to less than 5% of its original level).

The method and apparatus of the invention are particularly useful for drying metallic honeycomb structures such as electrically heated catalysts (EHCs) and diesel particulate filters. Honeycomb structures are generally characterized by inlet and outlet end faces, a matrix of intersecting walls defining or surrounding a plurality of open, elongated cells or passageways extending longitudinally and mutually parallel therethrough from the inlet to the outlet end face, and an outer surface. As used herein, the terms "honeycomb structure" is intended to embrace any monolithic structure having channels, cells or passageways. When formed into a honeycomb structure and fired, the plastically deformable material forms an article which is particularly useful as a support or substrate for a catalyst or as a particulate filter.

The plastically deformable, electrically conductive structure suitable for the invention can be made from stainless steel, silicon carbide, cermet, or other high temperature resistant material such as metals and metal alloys. Useful metals include iron, nickel, chrome and their alloys. Any material which is electrically conductive can be dried using the method and apparatus of the invention. Typically, green or unfired objects formed from electrically conductive particulate matter are dried using radiant and/or convective heat. Because of the difficulty of evenly distributing heat throughout such objects, radiant and convective heating methods have proved disadvantageous and expensive. In addition, conventional heating methods are slow and often cause the formed articles to sag or collapse before they are dried. There are other problems associated with conventional drying methods as applied to such materials. For example, differential heating across a formed body may lead to problems such as differential shrinkage, and skin formation in the immediate vicinity of the applied heat which in turn may cause various surface defects such as cracks, fissures, or checks. Differential heating may also cause deformation of the formed body by developing opposing compression and tension forces, the tension forces being developed by faster shrinkage of the outside of a formed body. In addition, as stated earlier, because the structure is dried in a fraction of the time normally needed for conventional drying methods, the occurrence of rust is significantly reduced or eliminated.

We have found that plastically deformable materials comprising metallic particles can be quickly and uniformly dried using energy in the radio frequency range without the previously expected problems. Previously, it was taught that even moderate exposures of such materials to radio frequency energy would destroy the body. It is known that a body formed from particulate metal-containing material, when subjected to radio frequency energy tends to be pyrophoric, particularly when very small particles of metal are used in the material. This is because the small particles tend to be more prone to rapid oxidation. As a result, exposure to radio frequency energy for even more than a few seconds, causes preferential edge heating which is then followed by rapid oxidation and likely ignition of the material. Continued exposure of such formed bodies to RF energy is likely to cause severe burning unless the time of exposure is limited by a time consuming and impractical process of sequential on-off operation of the RF device. According to the invention, many of the above problems related to RF heating of electrically conductive materials can be reduced or eliminated by protecting the conductive material with a shield positioned between the material and the electrodes.

The shield can be any material having a high dielectric constant, preferably having dielectric constant higher than the dielectric constant of air, and optionally, having breakdown voltage higher than air. The shield acts to diminish the field inside the structure, preventing field concentrations at the surface of the structure. Without the shield, the concentrated energy field leads to arcing through the air between the structure and the electrodes when the field strength exceeds the breakdown voltage of air (about $3\times10^6$ volts/meter). With the shield, concentration of energy field and therefore, arcing is avoided. For even better performance, the shield can be selected from material which is further characterized by having higher breakdown voltage than air.

In a preferred embodiment, the shield is made of quartz or other material having similar electrical properties such as the glass used to produce windows. Quartz is particularly suited for the invention because it has a dielectric constant of about 6 times higher than that of air. In addition, the breakdown voltage of quartz is an order of magnitude higher than that of air. We have found that the field strength inside the shield is inversely proportional to the ratio of the quartz/air dielectric constants. Therefore, the field strength inside the tube is approximately 1/6th of the field strength outside the shield.

Referring now to the diagrams. The shield may be in any form provided that the article or structure to be dried 30 is sufficiently protected from the electrodes 10. For example, the shield may be in the form of facing plates 15 separated by sufficient distance or space to accommodate the structure 30 as shown in FIG. 2. Alternatively, the shield can be in the form of a tube 20 as shown in FIG. 1, into which the structure 30 is placed. The tube 20 is preferably open on both ends to allow free air movement through the article.

The distance between the plates 15, and the length and diameter of the tube 20 may vary depending on the size and configuration of the article or structure 30. Similarly, the amount of separation between the electrodes 10 may also vary depending on the size of the article and the strength of the energy field.

Figure 1B:
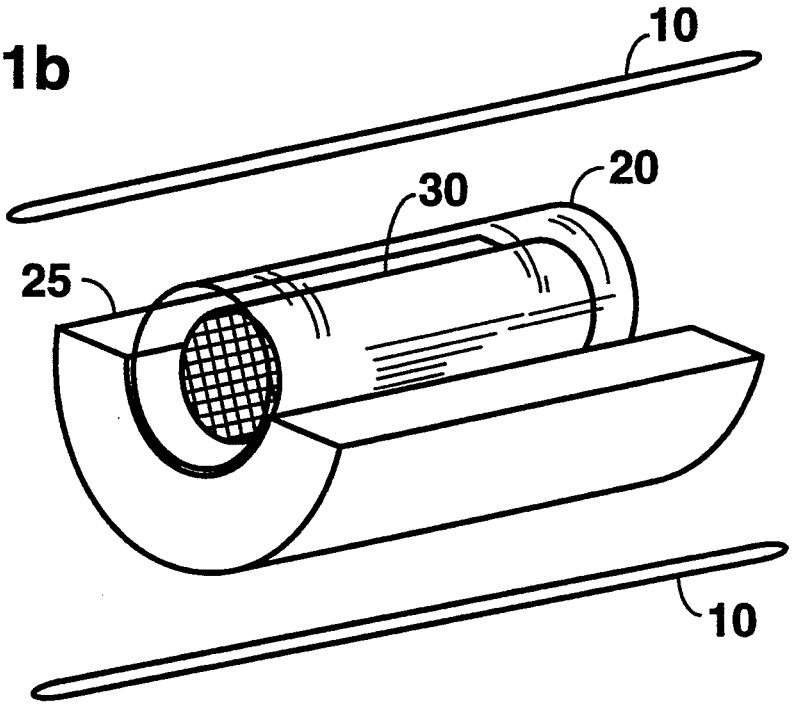
FIG. 1*b* is schematic diagram similar to FIG. 1*a*, but showing an alternate embodiment in which the cradle is outside the shield.
Figure 2:
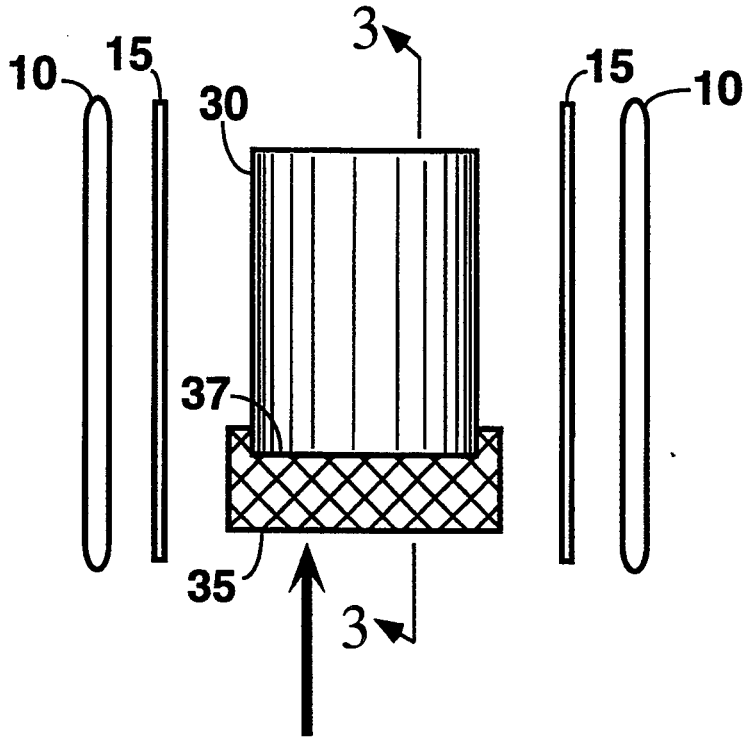
FIG. 2 is a schematic diagram showing a flat plate design of the shielding material and the relative placements of the shield, the formed structure, and the electrodes in a vertical dryer.

Preferably, the structure 30 is supported on a setter having a cradle which is preferably shaped to fit the configuration of the structure as shown in FIGS. 1*a*, 1*b* and 2. For example, in the horizontal drying embodiment (FIGS. 1*a* and 1*b*), the setter 25 provides a contoured cradle 27 on which the structure is supported. In the vertical drying embodiment of FIG. 2, the setter 35 provides a flat cradle 37. As contemplated by the invention, in the horizontal drying embodiment (FIGS. 1*a* and 1*b*), it may not be necessary to have a setter. Thus, if the structure to be dried has a circular outside surface, it may be supported directly in the tube without a setter. It is also contemplated that the tube 20 may be supported on a setter 25 such that the tube is separated from the electrodes 10 by the setter 25 as shown in FIG. 1*b*. If the tube is supported on a setter, then it is necessary that the setter be formed of a material which is compatible with high frequency energy such as for example, wood, glass, quartz or any material having a low absorption for high frequency energy. Preferably, the shield will absorb little or no energy in the high frequency range.

Arcing and burning in high frequency energy fields is believed to be caused by trapped or stagnant air pockets in localized regions of the energy field. Without intending to be bound by theory, it is believed that the arcing and/or burning may be due to ionization of the air by the energy field. Thus, the higher energy field, the greater the likelihood of arcing and/or burning. Also, we have observed that such problems tend to occur more frequently in the drier regions of the field. We have found that by providing means for creating continuous air movement through the field and the article, stagnant air pockets can be avoided thus reducing the occurrence of arcing and/or burning. This can be accomplished for example, by blowing air or inert gas (such as nitrogen), preferably at from room temperature to about 120° C., through the open sides of the tube in the direction indicated by the arrow in FIG. 1*a*. In the vertical drying embodiment FIG. 2 such as used in a rotary dielectric dryer, the setter 35 is chosen to allow free air movement. For example, the setter 35 can be of any structure having open cells to allow free air movement through the sample as shown by the direction of the arrow in FIG. 2. For setters having a cellular design, the cells can be diagonal or preferably parallel to the air direction. Continuous air movement also increases the rate of drying.

EXAMPLES

The cellular (honeycomb) metallic structures used in the following examples were prepared from plastically deformable materials consisting essentially of in percent by weight (a) about 5 to 40 chromium, (b) about 2 to about 30 aluminum, (c) 0 to about 5 of special metal selected from Y, lanthanides, Zr, Hf, Ti, Si, B, alkaline earth metal, Cu, and Sn, (d) 0 to about 4 of rare earth oxide additive, and (e) the balance being iron group metal and unavoidable impurities, such that the final composition included at least one component selected from (i) the special metal, and (ii) an effective amount of the rare earth oxide additive.

Figure 3:
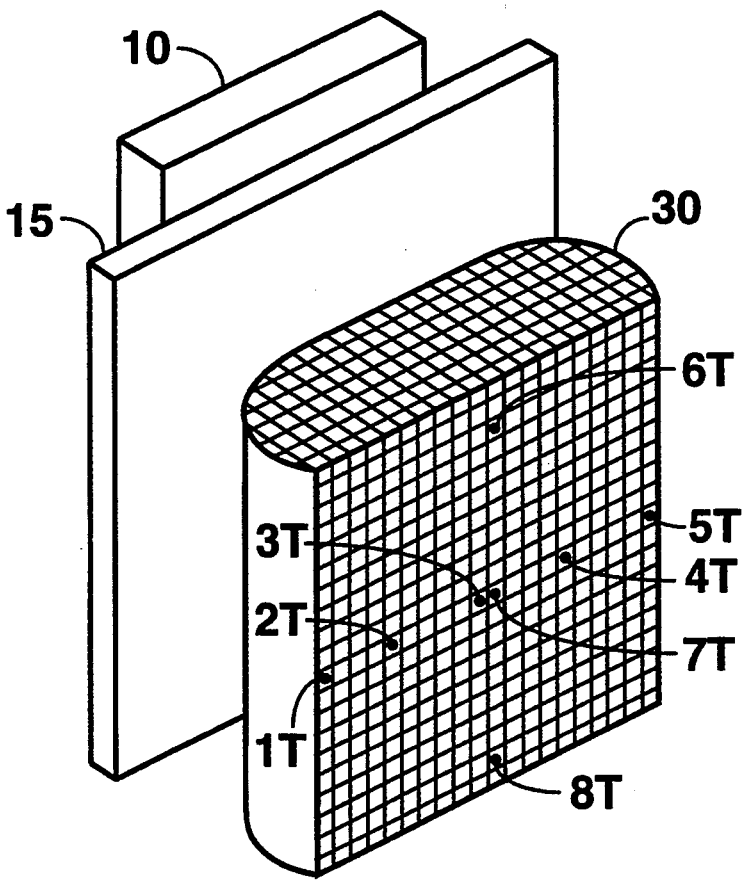
FIG. 3 is a section showing the placement of temperature probes (1T–8T) used to monitor the temperature of the experimental samples.

For each experiment, the temperatures at various locations were measured using probes which were placed at various locations in the samples using temperature probes 1T through 8T as indicated in FIG. 3. The probes were inserted into the samples by pushing the probes through the cells, with probes 1T and 5T measuring approximate skin temperatures. The temperature profiles of the various samples tested are summarized in Tables 3 and 4 below.

Even though the following examples were carried out using quartz tubes and normal glass plates as the shield, other materials and/or shapes can also be used provided such material possess the required electrical properties (dielectric constant and breakdown voltage).

1. Using Quartz Tubes as Shield

To demonstrate the apparatus and method of the invention, the above mixture was formed into several honeycomb structures measuring 1.6" diameter and 6" in length.

The samples were placed in a quartz tube (shield) measuring 18" in length and having inner diameter of 1.75 inches. The tube was placed on a mahogany cradle and loaded horizontally into a dielectric dryer such that the tube was separated from the bottom electrode by the cradle. The top electrode plate was positioned about 0.25 inches above the tube. The apparatus of this example is shown in FIG. 1*b*, with the sample-bearing cradle resting on the lower electrode. After one minute in the dielectric dryer, the sample had lost about 2.5% of its water. And after about two minutes it had lost about 5% of the water. No arcing was observed.

2. Using Glass Plates as Shield

The objective of the following experiments was to investigate the feasibility of using glass plates as the shield instead of quartz tubes. The above mixture was extruded into a metal honeycomb structure measuring 3.8" (diameter) and 5.5" (length). For support, the sample was loaded on a fired ceramic cradle.

The glass plates (shields) were fabricated using ordinary window glass having dimensions 21" (length)×12" (width)×0.25" (thickness). The glass plates were hung on either sides of the sample using NEXTEL fiber (a boron silicate, high purity, high temperature fiber available from 3M Company, St. Paul, Minn.). When completely assembled, the apparatus was as shown in FIG. 2, with the glass plate shields 15 positioned between the sample 30 and the electrodes 10.

Experiment 2(a)

In the first of these experiments, the electrodes were separated from each other by 6.5 inches, and the glass plate shields were separated from each other by 5.5 inches. In addition, through out the drying process, air at 85° C. was blown at the structure at maximum velocity (360–400 ft/min) in the direction indicated by the arrow in FIG. 2. The sample weights, temperature and dryer parameters were measured at the start of each experiment, and at 5 and 10 minutes. The results are tabulated in Table 3. As shown, after 10 minutes of exposure to 15 MHz of energy, the sample had lost about 48% of the total water content. At the same time, the sample temperature remained in the range of 29° to 69° C., well below the air temperature. No arcing was observed.

Experiment 2(b)

In this experiment, the assembly of Experiment 2(a) was repeated but without the blowing air.

In this example, after 10 minutes the sample had lost only about 25% of the total water while the sample temperature increased to between 72° and 88° C. Thus, even though the sample temperature was higher, the amount of water lost was significantly less. However, the temperature of the material was more consistent than in Experiment 2(a). Again, no arcing was observed. The results are summarized in Table 3.

Experiment 2(c)

In this experiment, the separation of the electrodes was reduced from 6.5 inches to 5 inches, while the separation of the glass shields was reduced to 4 inches. As in Experiment 2(b), no blowing air was used. The experiment could not be carried out for any significant length of time as arcing was observed almost instantaneously, perhaps due to formation of stagnant air pockets and/or the increased energy field (reduced space between electrodes).

Experiment 2(d)

In this experiment, the separation of the electrodes was increased to 5.5 inches, while that of the glass shields was increased to 4.75 inches. Again no blowing air was used. As in Experiment 2(c), there was instantaneous arcing.

In both experiments 2(c) and 2(d), a deposit of soot was observed on the side of the glass shield facing the sample. This corresponded to the sides of the shields which were damaged by the arcing. In addition, the samples were damaged on the sides of the samples facing the glass plates.

TABLE 3

| Time (min:sec) | Electrode/ Shield Separation (inches) | Temperature (deg. C.) 1 | 2 | 3 | 4 | 5 | 6 | 7 | 8 | Water Loss (%) |
|---|---|---|---|---|---|---|---|---|---|---|
| | | | | Exp. 2a | | | | | | |
| 0:0 | 6.5/5.5 | 7 | 6 | 2 | 8 | 10 | 8 | 0 | 8 | 0 |
| 5:00 | 6.5/5.5 | 34 | 28 | 28 | 42 | 47 | 30 | 29 | 64 | 29.1 |
| 10:00 | 6.5/5.5 | 33 | 30 | 35 | 41 | 45 | 29 | 38 | 69 | 48.3 |
| | | | | Exp. 2b | | | | | | |

TABLE 3-continued

| Time (min:sec) | Electrode/ Shield Separation (inches) | Temperature (deg. C.) 1 | 2 | 3 | 4 | 5 | 6 | 7 | 8 | Water Loss (%) |
|---|---|---|---|---|---|---|---|---|---|---|
| 0:0 | 6.5/5.5 | 11 | 9 | 10 | 11 | 12 | 10 | 11 | 15 | 0 |
| 5:00 | 6.5/5.5 | 83 | 71 | 76 | 83 | 81 | 76 | 76 | 61 | 10.5 |
| 10:00 | 6.5/5.5 | 80 | 77 | 82 | 88 | 86 | 81 | 72 | 72 | 25.4 |

3. Electrode Separation

In this experiment, the effect on drying, of the separation or spacing of the electrodes was investigated. The metal structure was an extruded honeycomb body similar to that used in Experiment 2 above, and measuring 3.8" (dia.)×6.0" (length).

Figure 4A:
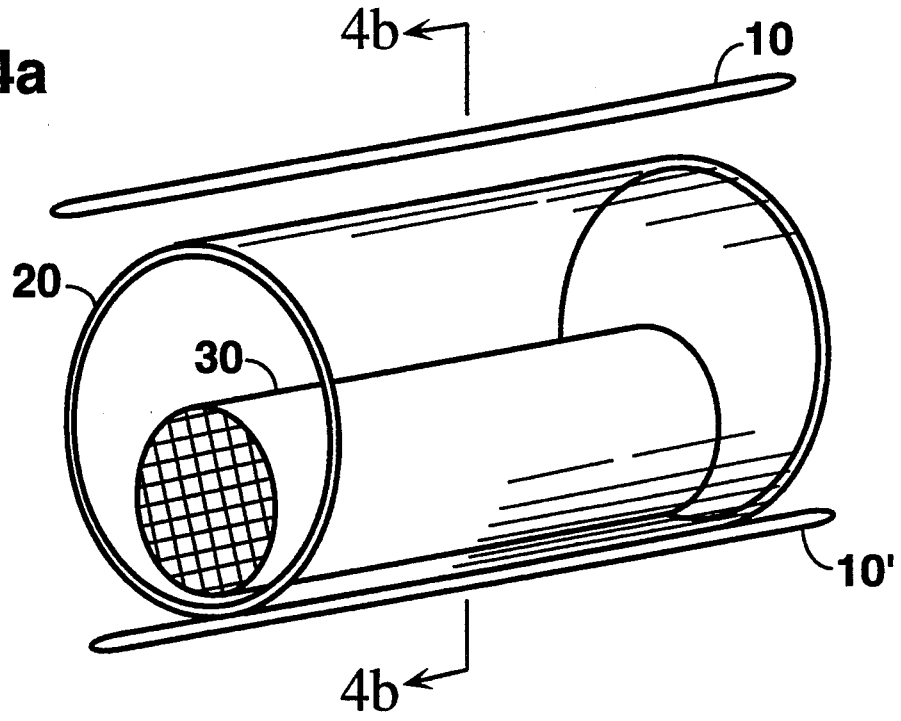
FIG. 4*a* is a schematic diagram of one embodiment of the invention in which the article to be dried is placed directly in a tube without a mantle.
Figure 4B:
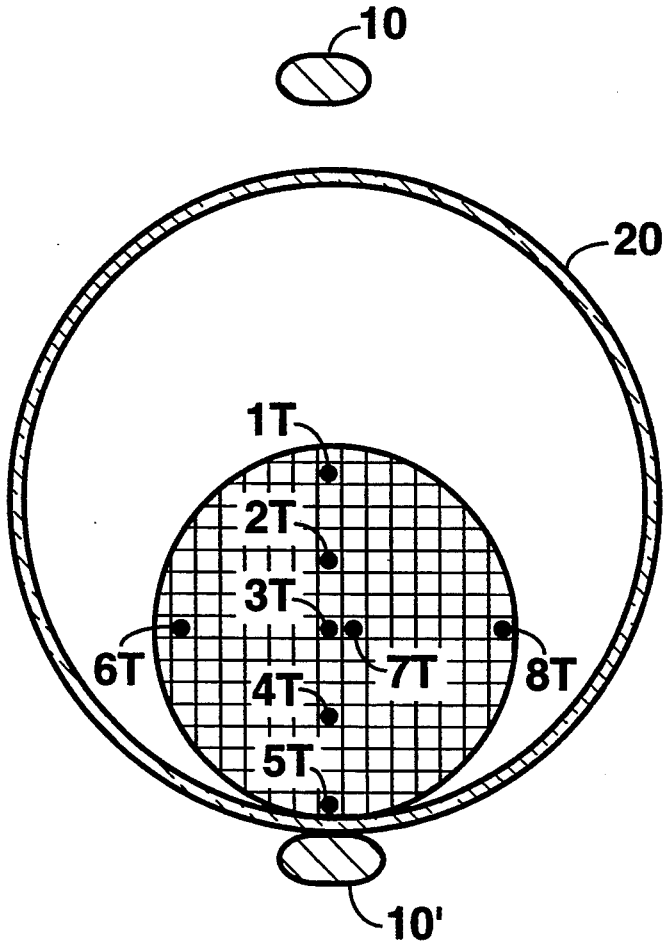
FIG.4 *b* is a section of FIG. 4*a* showing the position of the temperature probes used to obtain the temperature profile of Table 4 (Experiment 3).

In this example the structure 30 was placed directly in a quartz tube 20 measuring 5.125" (dia.)×11" (length) which was placed directly on the lower electrode 10' as shown in FIG. 4*a*. At various intervals, the samples were removed from the dryer for the purpose of measuring the weight and temperature of the structure. Temperature probes 1T–8T were positioned as shown in FIG. 4*b*. The results are summarized in Table 4 below.

TABLE 4

| Time (min:sec) | Electrode Separation (inches) | Temperature (deg. C.) 1 | 2 | 3 | 4 | 5 | 6 | 7 | 8 | Water Loss (%) |
|---|---|---|---|---|---|---|---|---|---|---|
| | | | | TRIAL #1 | | | | | | |
| 0:0 | 6 | −4 | −1 | −2 | −2 | −5 | −3 | −3 | −2 | 0 |
| 1:20 | 6 | 55 | 44 | 32 | 48 | 65 | 50 | 38 | 42 | 10.8 |
| 2:20 | 6 | 59 | 60 | 59 | 71 | 80 | 67 | 68 | 65 | 15.8 |
| 4:20 | 6.75 | 58 | 59 | 59 | 70 | 82 | 70 | 74 | 69 | 25.0 |
| 7:20 | 7.5 | 67 | 70 | 70 | 80 | 94 | 84 | 82 | 74 | 37.0 |
| | | | | TRIAL #2 | | | | | | |
| 0:0 | 7.5 | 19 | 15 | 13 | 13 | 14 | 14 | 13 | 15 | 0 |
| 3:0 | 7.5 | 42 | 50 | 53 | 65 | 83 | 67 | 76 | 68 | 9.5 |

Experiment 3a

In this experiment, the electrodes were initially separated by a distance of 6 inches. After 2 minutes 20 seconds, no arcing was observed and the sample had lost over 15% of its original water. The probes indicated relatively uniform heating with probe 5T consistently registering the highest temperature. As seen from the diagram, probe 5T measures the approximate skin temperature in the center portion of the structure 30 at a position closest to the lower electrode 10'. At this time, the separation of the electrodes was increased from 6 to 6.75 inches and continued to heat the sample. After an additional 2 minutes (i.e., total drying time of 4 minutes 20 seconds), the sample had lost about 25% of its original water (or an additional 10% in 2 minutes). Again, no arcing was observed.

The electrodes separation was again increased from 6.75 to 7.5 inches. After an additional drying time of 3 minutes (7 minutes 20 seconds total drying time), the sample had lost about 37% of its original water. Again, no arcing was observed. However, burning was observed on the end of the sample farthest from the source of the blowing air perhaps due to ionization of trapped or stagnant air. Burning generally occurs when all the water in a given area has been removed. Such localized burning can be prevented by controlling the air velocity and/or by positioning the air source to more evenly blow air at the sample during drying.

Experiment 3b

Using a newly formed cellular structure similar to those used in Experiment 3a, and placing probes 1–8 in the same positions, the electrodes were separated by 7.5 inches. After about 3 minutes, the sample had lost 9.5% of its original water, however, burning was again observed on the side of the article farthest from the air blower.

Without intending to be bound by theory, it is believed that air temperature, humidity, drying air velocity, direction of the drying air, orientation of the sample in the energy field, shape and size of the structure, separation of the electrodes, distance between the sample and the shield, distance between the shield and the electrodes, and other process variables may affect the drying of electrically conductive materials using high frequency energy. The optimal condition for a given setup may be readily determined by experimentation.

In addition to the embodiments discussed above, it should be understood that given the teachings herein, numerous alternatives and equivalents which do not depart from the present invention will be apparent to those skilled in the art, and are intended to be included within the scope of the present invention. It should also be understood that this invention is not to be unduly limited to the illustrative embodiments set forth herein.

We claim:

1. A method of drying electrically conductive structure by:

placing a wet electrically conductive structure in a shield having dielectric constant higher than the dielectric constant of air; and placing the shield and structure in an electromagnetic energy field in the frequency range of between about 10 MHz and 3.0 GHz to dry the structure, the electromagnetic energy field being generated by electrodes positioned on the outside of the shield away from the structure.

2. The method of claim 1, wherein the shield is further characterized by having a breakdown voltage greater than the breakdown voltage of air.

3. The method of claim 1, wherein the shield is selected from quartz and glass.

4. The method of claim 1, wherein the shield is separated from the electrodes by a distance of at least 0.25 inches.

5. The method of claim 1, wherein the shield comprises two facing plates separated by distance at least sufficient to accommodate the structure.

6. The method of claim 1, wherein the shield comprises a tube with sufficient length and internal diameter to accommodate the structure.

7. The method of claim 1, further comprising the step of creating continuous air movement through the field by creating air current inside the energy field.

8. The method of claim 7, wherein the air current is created by blowing air through the structure.

9. The method of claim 1, wherein the structure and shield are contacted with dielectric energy for a time sufficient to substantially dry the structure.

10. The method of claim 1, wherein the structure and shield are contacted with dielectric energy for a time sufficient to remove 5–50% of the original water content of the structure.

11. The method of claim 10, further comprising the step of placing the structure in a conventional oven to remove the remaining water and substantially dry the structure.

12. The method of claim 11, further comprising the step of firing the structure to form a sintered structure.

13. The method of claim 1, wherein the structure is a honeycomb structure.

14. A method of making an electrically conductive structure by:

combining electrically conductive particles, binder and water, to form a plastically deformable material;

shaping the plastically deformable material with a forming member to form a wet structure;

placing the structure in a shield having dielectric constant higher than the dielectric constant of air; and surrounding the structure and shield with electromagnetic energy field having frequency between about 10 MHz and 3.0 GHz.

15. The method of claim 14, wherein the forming member is an extrusion die.

16. The method of claim 14, wherein the electrically conductive particles comprise metals, cermet, carbides, carbon, metal alloys and mixtures of these.

17. The method of claim 16, wherein the particles comprise iron, zinc, aluminum, nickel, chrome and the mixtures of these metal.

18. The method of claim 14, wherein the binder is selected from methylcellulose, hydroxybutylmethylcellulose, polyvinyl alcohol, hydroxypropylmethylcellulose, hydroxyethylmethylcellulose, sodium carboxymethylcellulose, and mixtures thereof.

19. The method of claim 18, wherein the binder is characterized by a gel temperature of 50°–55°C., and a gel strength of 5000 g/cm$^2$ (based on a 2% solution at 65° C.).

20. The method of claim 14, wherein the plastically deformable material comprises 50–65% water.

21. The method of claim 20, wherein the structure is contacted with electromagnetic energy for a period sufficient to reduce the water content to less than about 30% of its original level.

22. The method of claim 21, further comprising the step of drying structure in a conventional oven at a temperature in the range of 60°–150° C. for a period sufficient to remove the remaining water.

23. The method of claim 21, wherein the shield comprises a pair of facing glass plates separated by a distance sufficient to accommodate the structure, and wherein the electromagnetic energy field is created by a pair of facing electrodes separated by a distance sufficient to accommodate the shield and structure.

24. The method of claim 14, further comprising the step of providing continuous air movement in the energy field by blowing air over the structure as the structure is contacted with high frequency energy.

25. The method of claim 24, wherein the air is at a temperature in the range of 23° to 100° C.

26. The method of claim 14, wherein the electrically conductive particles are metallic.

27. The method of claim 14, wherein the electrically conductive particles are magnetic.

28. The method of claim 14, wherein the electrically conductive material consists essentially of in percent by weight:

(a) about 5 to 40 chromium;

(b) about 2 to about 30 aluminum;

(c) 0.01 to about 5 of special metal selected from Y, lanthanides, Zr, Hf, Ti, Si, B, alkaline earth metal, Cu, and Sn; (d) 0.01 to about 4 of rare earth oxide additive; and (e) the balance consisting essentially of iron group metal.

29. The method of claim 14, wherein the structure is contacted with the electromagnetic energy as it emerges from the forming member.

* * * * *